United States Patent [19]

Crane et al.

[11] Patent Number: 4,843,770

[45] Date of Patent: Jul. 4, 1989

[54] SUPERSONIC FAN NOZZLE HAVING A WIDE EXIT SWATH

[76] Inventors: Newell D. Crane, 5988 Woodridge Dr., Milford, Ohio 45150; David E. Moore, 212 Southampton Rd., Louisville, Ky. 40223

[21] Appl. No.: 86,405

[22] Filed: Aug. 17, 1987

[51] Int. Cl.[4] ..... B24C 5/04

[52] U.S. Cl. ..... 51/439; 51/427; 239/510; 239/521; 239/600

[58] Field of Search ..... 51/439, 319, 320, 321, 51/427; 239/499, 510, 518, 521-522, 591, 597, 600

[56] References Cited

U.S. PATENT DOCUMENTS

| | | | |
|---|---|---|---|
| D. 409,751 | 8/1889 | Mathewson | 51/439 |
| 1,133,711 | 3/1915 | Cornelius | 239/591 |
| 2,606,073 | 8/1952 | Uhri | 51/439 |
| 2,897,692 | 8/1959 | Beckner | 51/319 |
| 3,662,497 | 5/1972 | Thompson | 51/439 |
| 4,169,556 | 10/1979 | Müller | 239/597 |
| 4,306,684 | 12/1981 | Peterson | 239/597 |
| 4,641,786 | 2/1987 | Moore | 51/439 |

FOREIGN PATENT DOCUMENTS

| | | | |
|---|---|---|---|
| 0009147 | 6/1879 | Fed. Rep. of Germany | 51/414 |

*Primary Examiner*—Frederick R. Schmidt
*Assistant Examiner*—Robert A. Rose
*Attorney, Agent, or Firm*—Frost & Jacobs

[57] ABSTRACT

A pair of guide plates or deflectors are secured adjacent the exit of a discharge nozzle body. The body includes a circular inlet portion converging to a flattened, rectangular passageway. The guide plates are secured adjacent the exit of the flattened passageway. As air flow exits from the flattened passageway, the guide plates constrain the flow's natural expansion to the forward and lateral directions only, thereby creating a wide cleaning swath.

3 Claims, 2 Drawing Sheets

SUPERSONIC FAN NOZZLE HAVING A WIDE EXIT SWATH

BACKGROUND OF THE INVENTION

1. Field of the Invention

The present invention relates generally to nozzles, and in particular, is concerned with a supersonic fan nozzle having guide plates or deflectors for providing a broad exit swath.

2. Description of the Related Art

Supersonic nozzles are well-known in the art. Conventional venturi-type nozzles include a converging section, a throat and a diverging section. If sufficient pressure is applied to a venturi-type nozzle, air velocity at the throat will become sonic, and then increase as the air expands at the diverging section to produce a supersonic outlet velocity. The exact exit velocity depends on air pressure, size and other details of the nozzle design. Such nozzles are readily commercially available.

Various nozzle designs have been incorporated in sand blasting applications. Air and sand are mixed and discharged through a nozzle. Representative examples of sand blasting and spraying nozzles are found in U.S. Pat. No. 773,665; 990,409; 1,326,913; 1,410,117; 2,341,036; 2,605,596; 2,606,073; 4,038,786; 4,389,820 and 4,633,623.

The discharge pattern from many commercially available nozzles is circular or round. In order to obtain a uniform cleaning pattern on a surface, it is necessary to have considerable overlap of the discharge, sometimes by as much as fifty percent. Such overlap is time-consuming and uneconomical. Fan-shaped nozzles have also proved inadequate because of rapid erosion of internal passages Such erosion requires frequent nozzle replacement.

It is known in the art to discharge carbon dioxide pellets from a spray nozzle in a cryogenic cleaning apparatus. Such a method and apparatus are disclosed in U.S. Pat. No. 4,617,064 issued in 1986 to a co-applicant of this invention.

Consequently, a need exists for improvements in discharge nozzles utilized with cleaning devices. It is desirable that a discharge nozzle provide a supersonic outlet velocity and a wide cleaning swath. It is also desirable that the nozzle be durable and long lasting.

SUMMARY OF THE INVENTION

The present invention includes a discharge nozzle that provides a wide cleaning swath at supersonic outlet velocities. This discharge nozzle is particularly well-suited for use with a cyrogenic cleaning apparatus. The device is durable, easy to manufacture and maintain and economical.

In a preferred embodiment, the present invention includes a pair of guide plates or deflectors secured adjacent the exit of a discharge nozzle body. The body includes a circular inlet portion converging to a flattened, rectangular passageway. The guide plates are secured adjacent the exit of the flattened passageway. As air flow exits from the flattened passageway, the guide plates constrain the flow's natural expansion to the forward and lateral directions only, thereby creating a wide cleaning swath.

DETAILED DESCRIPTION OF THE PREFERRED EMBODIMENTS

Figure 1:
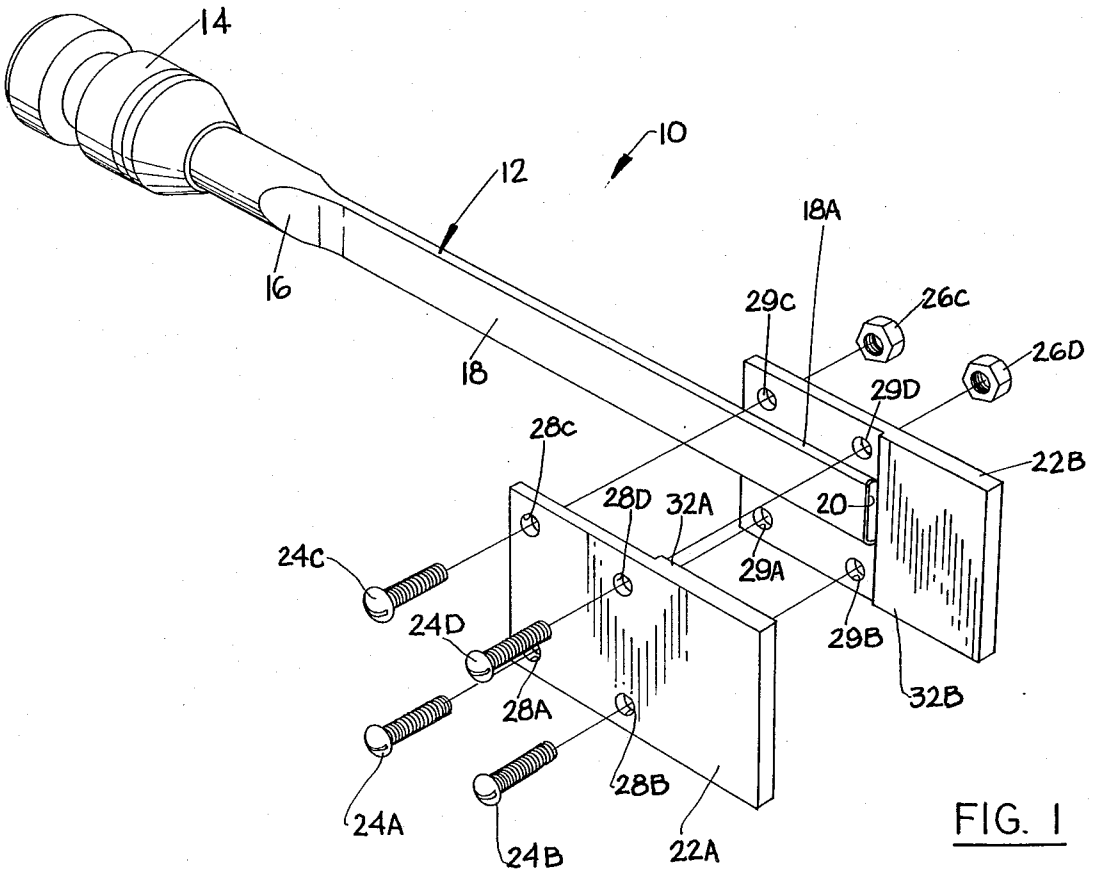
FIG. 1 is a partially-exploded perspective view of a preferred embodiment of the nozzle of the present invention.

A preferred embodiment of the present nozzle, indicated generally at 10, is illustrated in FIGS. 1–4. A discharge nozzle body 12 includes an inlet portion 14, a throat portion 16, a passageway 18 and an exit 20.

As illustrated in the figures, it is desirable that the cross section of the inlet portion 14 be circular. It is preferred that the cross section of the passageway 18 be rectangular. It is further preferred that the cross section of passageway 18 be flattened and substantially less than the cross section of the inlet portion 14. It is understood that other cross sections and shapes are within the scope of the present invention.

A pair of deflectors or guide plates 22A and 22B are secured to the flattened passageway 18 adjacent the exit 20. The deflectors 22A and 22B can be secured to the passageway 18 in any constraint manner, e.g. by bolts 24A–24D and nuts 26A–26D (26A is not illustrated). Bolts 24A–24D are threaded through respective openings 28A–28D and 29A–29D in deflectors 22A and 22B and held in place by nuts 26A–26D, respectively. It is understood that other fasteners can be utilized to secure deflectors 22A and 22B to the passageway 18. Furthermore, the deflectors 22A and 22B can be secured to the passageway 18 by welding and the like. In certain applications, it may be desirable to include flanges on the outer surface 18A of the passageway 18 adjacent the exit 20. Fasteners can be inserted through the flanges. The deflectors 22A and 22B can be welded or otherwise secured to such flanges.

Figure 4:
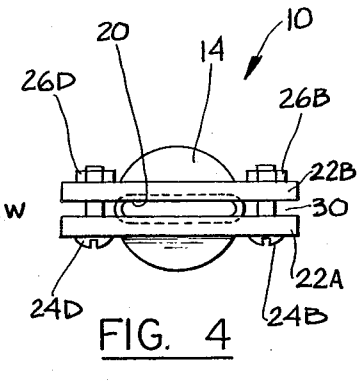
FIG. 4 is an end view of the nozzle of FIG. 2.
Figure 2:
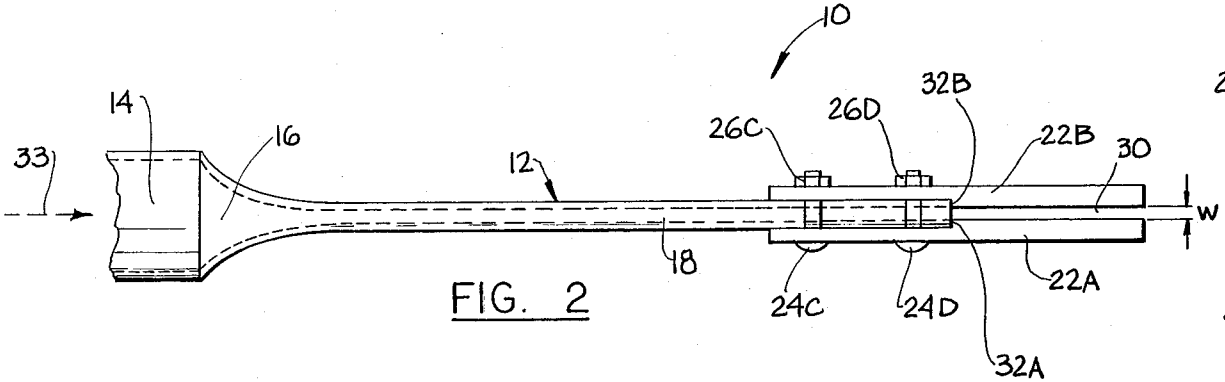
FIG. 2 is a top view of an assembled nozzle of FIG. 1.
Figure 3:
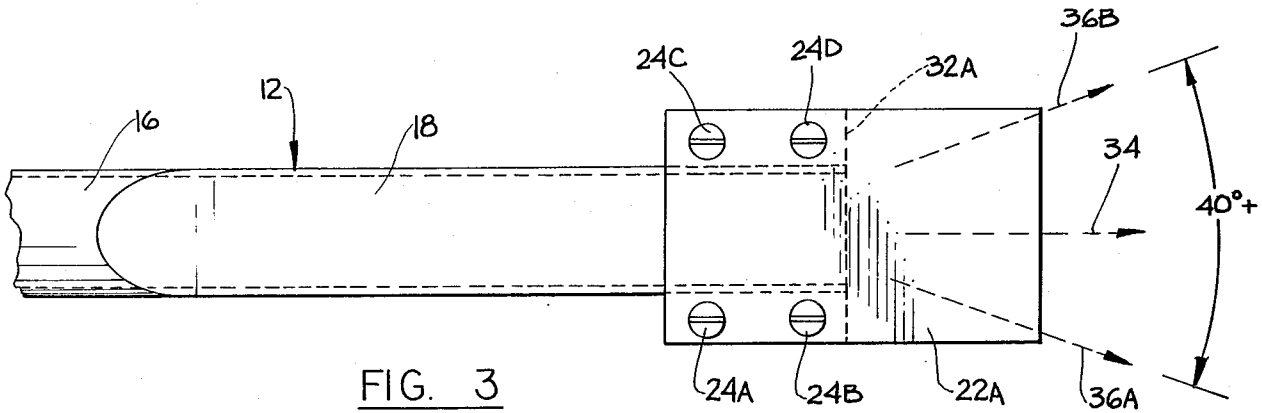
FIG. 3 is an enlarged, partial side view of the nozzle of FIG. 2.

As illustrated in FIGS. 2 and 4, a gap 30 remains between the deflectors 22A and 22B beyond exit 20 after the deflectors 22A and 22B have been installed on the passageway 18. It is preferred that gap 30 be substantially equal to the lateral width W of exit 20. In order to achieve such placement, a stepped surface 32A and 32B is provided on the surface of each deflector 22A and 22B, respectively, adjacent the passageway 18. It is preferred that each stepped surface 32A and 32B be substantially the same width as the thickness of the outer walls of the passageway 18.

In operation, the inlet portion 14 is connected to a source of air or other gases indicated by arrow 33. Air passes through the inlet portion 14, throat 16 and passageway 18 and achieves a sonic velocity due to the reduction in cross-sectional area and by the boundary layer of friction along the length of the inner walls of te passageway 18.

As the air leaves the exit 20, a sudden, natural expansion phenomena occurs. This expansion to atmospheric pressure, known as the Prandtl-Meyer effect, creates a small spherical region of gases which is expanding in all directions. However, as the air leaves exits 20, deflectors 22A and 22B constrain the expansion to the forward and lateral directions only, as indicated by arrows 34 and 36A and 36B, respectively.

The constraint on the expansion of air from exit 20 by deflectors 22A and 22B increases the velocity of the exiting gases. Furthermore, the swath of the gases can be broadened to an angle of forty or more degrees.

The present nozzle 10 is particularly well-suited for use with a cyrogenic cleaning apparatus. Carbon dioxide pellets carried by air are directed by deflectors 22A and 22B into a broad swath. Such a swath substantially increases the cleaning effectiveness of a nozzle without deflectors 22A and 22B.

It will be understood that the present nozzle 10 has other applications, e.g. sand blasting. Furthermore, many variations in exit velocity, pellet fan divergence angle, deflector size and spacing, effective working distance as a function of supply pressure are all within the scope of the present invention.

Although the present invention has been described with reference to preferred embodiments, workers skilled in the art will recognize that changes may be made in form and detail without departing from the spirit and scope of the invention.

What is claimed is:

1. A nozzle for directing a cleaning fluid in a wide swath, comprising:

(a) a nozzle body comprising an inlet portion, a throat, a narrow passageway having walls defining a rectangular cross section interior, and an exit therefrom;

(b) a first deflector, having an inner surface, said inner surface having a step whose thickness is substantially the same as the thickness of said walls;

(c) a second deflector, having an inner surface, said inner surface having a step whose thickness is substantially the same as the thickness of said walls; and (d) means for securing said first and second deflectors to the passageway adjacent said exit, thereby defining a gap between said deflectors beyond said exit whose width is substantially the same as the width of said exit, whereby the natural expansion of the fluid from said exit is constrained to forward and lateral directions only.

2. A discharge nozzle comprising:

(a) a nozzle body having an inlet portion of circular cross section, converging to a narrow passageway having a flattened and rectangular cross section and exit therefrom; and (b) a pair of guide plates secured to said nozzle body adjacent said exit, each of said guide plates having a stepped configuration on the surface adjacent said exit whose thickness is substantially the same as the thickness of the walls of the passageway, for directing the flow from said nozzle body in a wide swath.

3. The nozzle as specified in claim 2 wherein a gap between the guide plates beyond said exit is substantially the same width as the lateral width of said exit.

* * * * *